US007562636B2

(12) United States Patent
Regala

(10) Patent No.: US 7,562,636 B2
(45) Date of Patent: Jul. 21, 2009

(54) WRITING INSTRUMENT HOLDER AND BOOKMARK

(75) Inventor: Alan C. Regala, Mountain View, CA (US)

(73) Assignee: Everyday Innovations Inc., Mountain View, CA (US)

( * ) Notice: Subject to any disclaimer, the term of this patent is extended or adjusted under 35 U.S.C. 154(b) by 0 days.

(21) Appl. No.: 11/744,170

(22) Filed: May 3, 2007

(65) Prior Publication Data

US 2007/0269257 A1 Nov. 22, 2007

Related U.S. Application Data

(60) Provisional application No. 60/802,183, filed on May 19, 2006, provisional application No. 60/819,544, filed on Jul. 6, 2006.

(51) Int. Cl.
*B42D 9/00* (2006.01)

(52) U.S. Cl. ..... 116/239; 116/234

(58) Field of Classification Search ..... 116/234–240; 281/42

See application file for complete search history.

(56) References Cited

U.S. PATENT DOCUMENTS

| | | | | | |
|---|---|---|---|---|---|
| 2,300,216 | A | * | 10/1942 | Grodsky et al. | 116/237 |
| 3,577,604 | A | | 5/1971 | Brosk | |
| 3,823,814 | A | | 7/1974 | Lum | |
| 3,898,951 | A | | 8/1975 | Clare | |
| 4,162,800 | A | | 7/1979 | Gonot, Jr. et al. | |
| 4,505,219 | A | | 3/1985 | Mangano | |
| 4,856,647 | A | | 8/1989 | Dahne | |
| 5,016,559 | A | * | 5/1991 | Larson et al. | 116/234 |
| 5,054,816 | A | | 10/1991 | Rosengarten | |
| 5,405,010 | A | * | 4/1995 | Goldberger | 206/5 |
| 5,446,953 | A | | 9/1995 | LeFeber | |
| 5,636,868 | A | * | 6/1997 | Ross, Jr. | 281/42 |
| 6,446,803 | B1 | * | 9/2002 | McKinney | 206/371 |
| 6,481,367 | B2 | | 11/2002 | McClosky | |
| 7,004,106 | B1 | | 2/2006 | Forance | |
| D517,604 | S | | 3/2006 | Rowe | |
| D580,988 | S | * | 11/2008 | Regala | D19/81 |
| 2002/0083884 | A1 | * | 7/2002 | McClosky | 116/235 |
| 2005/0081776 | A1 | * | 4/2005 | Moranville | 116/238 |

* cited by examiner

*Primary Examiner*—R. A. Smith
(74) *Attorney, Agent, or Firm*—Fliesler Meyer LLP

(57) ABSTRACT

Provided herein is various embodiments of a combined writing instrument holder and bookmark for use with a book and at least one writing instrument. The combined writing instrument holder and bookmark includes a first loop, a second loop and an elongate member. The first loop is generally sized to snugly receive at least a cover of a book. The second loop is generally sized to snugly receive a writing instrument so that a writing instrument can be secured to a book while the first loop receives at least a cover of a book. The elongate member has an attached end, a free end and a length therebetween, with the length useful as a bookmark while the first loop receives at least a cover of a book. Additional and alternative features are also provided.

13 Claims, 7 Drawing Sheets

WRITING INSTRUMENT HOLDER AND BOOKMARK

PRIORITY CLAIM

This application claims priority under 35 U.S.C. 119(e) to the following provisional applications, each of which is incorporated herein by reference: U.S. Provisional Patent Application 60/802,183, filed May 19, 2006; and U.S. Provisional Patent Application 60/819,544, filed Jul. 6, 2006.

FIELD OF INVENTION

This invention relates to writing instrument accessories and bookmarks, and in specific embodiments, to such bookmark which may releasably hold a writing instrument to different sized books.

BACKGROUND OF THE INVENTION

People who use journals and notebooks often need a writing instrument. More often than not, the journal or notebook does not contain an integrated holder for such an instrument, so the user must carry the instrument separately. This can result in the user forgetting or losing the instrument. This also pertains to textbooks and the need to carry a highlighter. It is inconvenient to have the book and writing instrument separated, especially when the user is on-the-go and doesn't want to carry a backpack, briefcase, or other carrying case, in which one might normally store a pen or highlighter. The device of the present invention overcomes this problem by attaching the writing instrument to the book so the user will never forget it. It also functions as a bookmark or book closure device.

Examples of prior art include elastic bookmark and writing instrument combinations such as U.S. Pat. No. 4,162,800 to Gonot, Jr. et al. (1979) and U.S. Pat. No. 6,481,367 B2 to McClosky (2002).

Gonot's invention is a simple elastic loop with two transverse slits, which allows a pen to be held within these slits. Although it is simple and easy to manufacture, there are some distinct disadvantages of this design: 1) Since the slits are made in the elastic, they will be spaced at different distances as the elastic is stretched, depending on the size of the book. This may cause the holder to no longer receive the pen; 2) The holder is limited in the length and diameter of the pen to which it can receive; 3) Since the pen is held on the face of the book, the book can no longer be stacked with other books, as the cover is no longer flat. This can be problematic when storing books in a backpack or on a bookshelf. 4) The holder is not easy to quickly attach or remove from the book.

McClosky's design contains an elastic member with a pouch to hold a writing instrument and a separate ribbon with a bookmark/placesaver. As with Gonot's design, since the pen is held on the face of the book, the book can no longer be stacked with other books, as the cover is no longer flat. This can be problematic when storing books in a backpack or on a bookshelf. Also, the holder is not easy to quickly attach or remove from the book. All the additional components in this design (hook and loop, placesaver, etc) make it more complex and expensive to manufacture.

Accordingly, it would be advantageous to provide a writing instrument holder, which can be easily attached to and removed from a book, which provides easy access to the writing instrument while using the book, which provides the convenience of a bookmark or book closure device, which does not prevent the book from being stored conveniently, which is inexpensive to manufacture, and which will present a large surface for the reception of graphics, including company logos, artwork, text, etc.

SUMMARY

Embodiments of the present invention are related to a combined writing instrument holder and bookmark for use with a book and a writing instrument. The combined writing instrument holder and bookmark includes a first loop of material generally sized to snugly receive at least a cover of a book, with the first loop defining a first central axis. Also, a second loop, that is attached to and adjacent the first loop, is generally sized to snugly receive a writing instrument so that a writing instrument can be secured to a book while the first loop receives at least a cover of a book. The second loop defines a second central axis that is generally parallel to the first central axis.

In accordance with an embodiment, the combined writing instrument holder and bookmark also includes an elongate member having an attached end, a free end and a length therebetween. The attached end of the elongate member is attached to at least one of the first and second loops. The length of the member is useful as a bookmark while the first loop receives at least a cover of a book.

In accordance with an embodiment, the first and second loops are formed from a single loop of material (e.g., an elastic material) that is bonded together at a location along the single loop to form two loops (i.e., the first and second loops). In accordance with an embodiment, the attached end of the elongate member is attached adjacent to the location where the single loop is bonded together to form the first and second loops. Stitching can be used to bond together the single loop to form the first and second loops and also to attach the attached end of the elongate member. Even more specifically, the same the stitching can be used to bond together the single loop to form the first and second loops and also to attach the attached end of the elongate member.

Attaching the elongate member near or at where the first and second loops meet allows the elongate member to be used as a bookmark without having to remove or reposition the first loop or remove or reposition a writing instrument. If the user does not wish to use the elongate member as a bookmark, the elongate member can remain flat against the first loop, where it will not be a hindrance during book usage or storage. The relative placement of the second loop with respect to the elongate member allows a writing instrument to remain easily accessible during open and closed book positions, while the function of the elongate member is not impeded by the presence or absence of a writing instrument. Using various graphics and designs, the elongate member can also be used as a decorative enhancement to the device.

In accordance with an embodiment, the combined writing instrument holder and bookmark also includes a third loop sized to snugly receive a further writing instrument, so that a further writing instrument can also be secured to a book while the first loop receives at least a cover of a book and the second loop receives a writing instrument. The third loop has a third central axis that is generally parallel to the first central axis and the second central axis. The second loop and the third loop can be about the same size. Alternatively, the second loop and the third loop can be different sizes to accommodate writing instruments of different diameters.

In accordance with an embodiment, the first, second and third loops are formed from a single loop of material (e.g., an elastic material) that is bonded together at two different locations along the single loop to form three loops (i.e., the first, second and third loops). In a specific embodiment, the second and third loops are about 180 degrees apart from one another relative to the first loop, so that two writing instruments can be secured to opposite edges of a book while the first loop receives at least a cover of a book. For example, writing instruments can be stored at the top and bottom edges of a book, which allows the book to store flat against other books on a bookshelf, table or in a backpack. The relative placement of the second and third loops with respect to one another also allows the user to access two writing instruments while the book is open. More specifically, since a writing instrument will be at the top and/or bottom of the cover, the user can simply reach a short distance to remove the writing instrument without closing or turning the book. In essence, the second and third loops are storage facilities when the book is not in use, and they become docking stations when the book is in use. When not holding a writing instrument, the second and/or third loop can also be used as a pull tab to assist in securing and removing the first loop around at least a cover of a book.

In accordance with an embodiment, the combined writing instrument holder and bookmark also includes a fastener having a first part and a second part, such as hook and loop parts or snap halves. The first part of the fastener is attached to an outer circumference the first loop, at least 180 degrees away from where the attached end of the elongate member is attached to the first loop. The second part of the fastener is attached to the elongate member near the free end of the elongate member. In such an embodiment, the length of the elongate member is preferably longer than the first loop when the first loop is flat. While the first loop receives at least a cover of a book, the elongate member can wrap around one or more pages of the book, and the first part of the fastener can attach to the second part of the fastener, to thereby secure the one or more pages to the cover of the book.

This description is not intended to be a complete description of, or limit the scope of, the invention. Other features, aspects, and objects of the invention can be obtained from a review of the specification, the figures, and the claims.

DRAWING FIGURES

In the drawings, closely related figures have the same number but different alphabetic suffixes. The distinctions between figures with different alphabetic suffixes are readily understandable.

DETAILED DESCRIPTION

Figure 1:
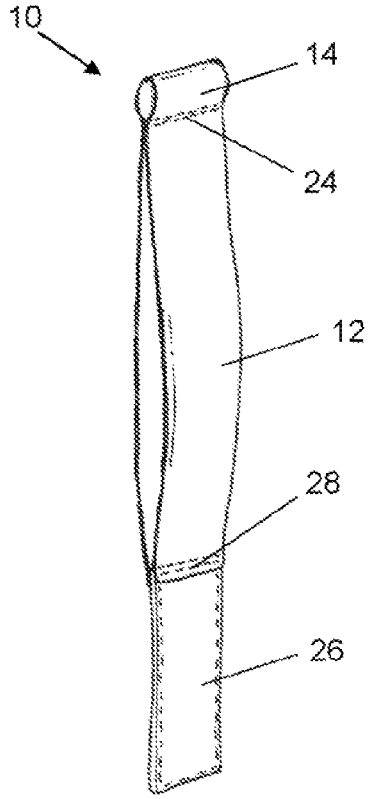
FIG. 1 is a perspective view showing the writing instrument holder and bookmark device of the present invention.

FIGS. 1 & 2:

A writing instrument holder 10 (herein after called a pen holder, or simply a device) is shown according to an embodiment of the invention. Pen holder 10 is made from an elastic band material, such as rubber or elastic stretch fabric, and is formed to define two loops, a main loop 12 and a smaller pen loop 14. Smaller pen loop 14 is sized and shaped to snugly hold a writing instrument 16 (herein after called "pen"). While referred to as pen loop 14, this loop can hold any type of writing instrument, including but not limited to a pen, pencil, marker, highlighter, or the like. Main loop 12 is sized and shaped to snugly fit about either a whole book 18, the front or rear book cover 20, or the front or rear book cover and some book pages 22. Since the pen holder is composed of stretchable material, the device will work for a limited range of different sized books. In order to accommodate the entire range of book sizes from large textbooks to small address books or a stack of index cards, the pen holder may be created in a few different sizes by varying the length of the main loop. Main loop 12 and pen loop 14 are formed integrally from the band material by bonding the band material at a single bonding point 24. Bonding point 24 may include appropriate stitching, adhesive or heat weld, depending on the material selected for the band material. In another embodiment, pen loop 14 may also be made from a separate material that is bonded to main loop 12 at bond point 24.

While it is most inexpensive and efficient to create the loops from one single elastic band, inelastic segments may be incorporated in the loops to vary the stretch length and force range of the device or for decorative purposes.

The actual size of the two loops 12, 14, will vary according to the size of the intended book and pen. This being said, Applicant has determined that pen loop works best at holding a majority of pen sizes if it is formed having a resting diameter range between approximately ¼" and ⅝".

The preferred width of pen holder 10 is at least 0.5" so that pen 16 is held firmly in place. If the width is smaller than 0.5" the instrument may tend to flop around loosely and potentially get caught on another object during transportation.

Figure 2:
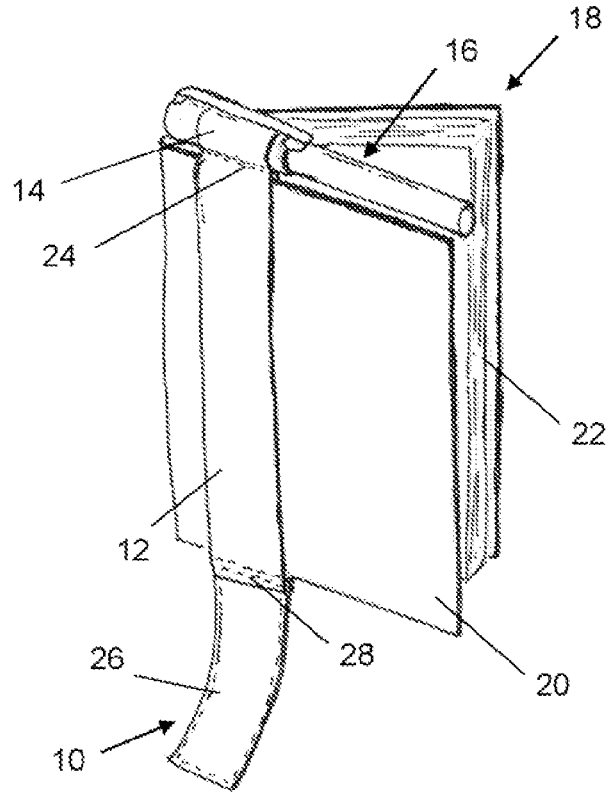
FIG. 2 is a perspective view showing the writing instrument holder and bookmark attached to the cover of a book.
Figure 3:
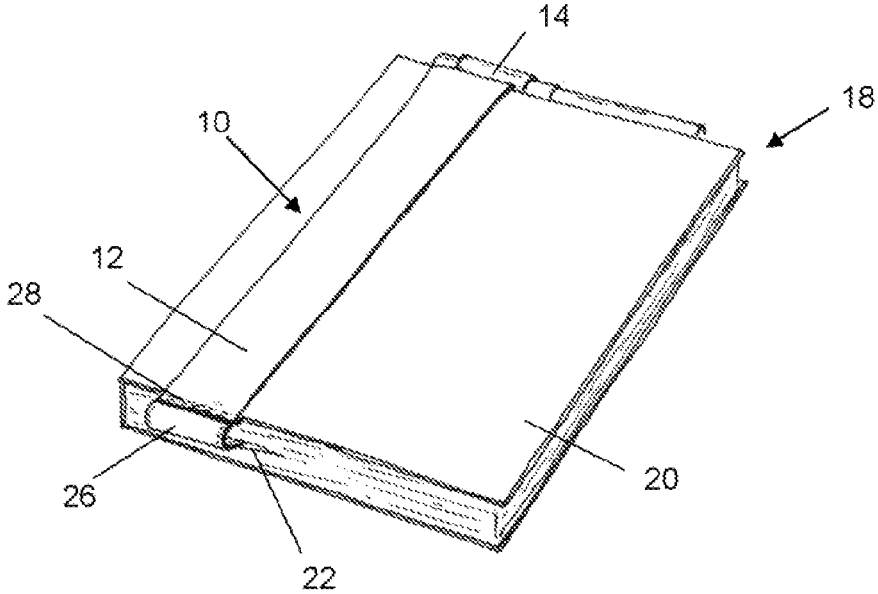
FIG. 3 is a perspective view showing the pull tab of the present invention used to mark a page in a book.

Referring to FIG. 2, main loop 12 is stretched around book cover 20, which provides the user convenient access to the pen while book 18 is in use. Pen 16 is stored parallel to the top pages of book 18, so the book can still be easily stored on a book shelf or in a backpack such that the pen 16 is unobtrusive, and the book faces can rest flat against other books or surfaces. Some prior art designs place the pen on the face of the book, not allowing the book to store as neatly or easily. The relative placement of the pen loop with respect to the device orientation on the book also allows the user to access the pen while the book is open; since the pen is at the top or bottom of the cover, the user can simply reach a short distance to remove the pen without closing or turning the book. In essence, the pen loop is a storage facility when the book is not in use, and it becomes a docking station when the book is in use.

In another embodiment, a pull tab 26 is connected to main loop 12. Pull tab 26 has multiple functions. One function of pull tab 26 is to assist the user in stretching main loop 12 while securing pen holder 10 to or removing from a book. Without this feature, the user would need to insert his finger into main loop 12 and pull, which could cause his finger to get caught between main loop 12 and book, or grasp the outside end of main loop with a limited grip and pull, possibly leading to accidental release due to insufficient gripping surface area.

FIG. 3:

Another function of pull tab 26 is to allow the user to mark a page 22 within book 18 for future reference. Unlike other elastic bookmarks which require that the entire band is stretched over the cover and pages to mark a specific page, pull tab 26 allows the user to leave pen holder 10 in place before, during and after book usage, which is much more convenient.

Yet another function of pull tab 26 is to provide ample space for custom logos or graphics for individuals or groups such as schools and companies.

In another embodiment, pull tab 26 is a separate inelastic material bonded to main loop at a single point 28. Bonding point 28 may include appropriate stitching, adhesive or heat weld, depending on the materials selected for the main loop and pull tab. Pull tab 26 has appropriate length to be placed between book pages 22 while main loop 12 is wrapped around book cover 20. Pull tab 26 has appropriate thickness such that the material easily bends back into book pages 22 without permanently deforming the material or causing the book to open. Since one function of pull tab 26 is to assist in stretching main loop 12 for ease of attachment and removal, an inelastic material is preferred, such as cloth, plastic, suede or leather. This material also is used to enhance the aesthetic value of the pen holder. Pull tab 26 may be composed of single or multiple layers of material. While a single layer is preferred due to less manufacturing cost, multiple layers allow a convenient pocket to be formed, which will be discussed in subsequent paragraphs.

FIG. 4:

In another embodiment, pull tab 26 is an extension of band material creating main loop 12, such that bonding point 28 separates main loop 12 and pull tab 26. An integrated pull tab 26 reduces the manufacturing cost, although it may not be as aesthetically pleasing or as functionally superior as a separate material.

Figure 6B:
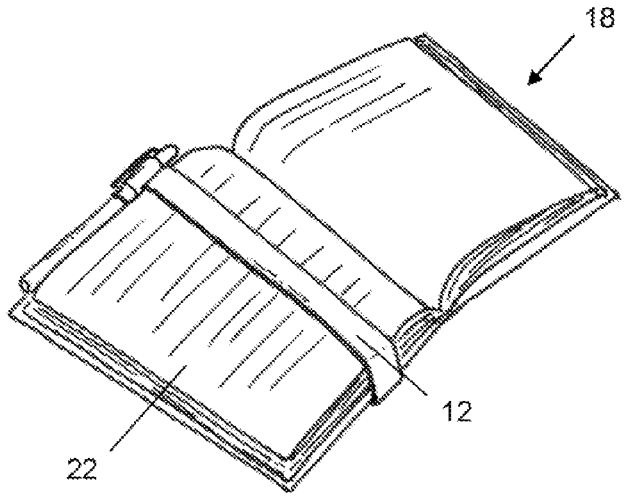
FIG. 6B is a perspective view showing the writing instrument holder and bookmark, without the pull tab, marking the page of a book.
Figure 5:
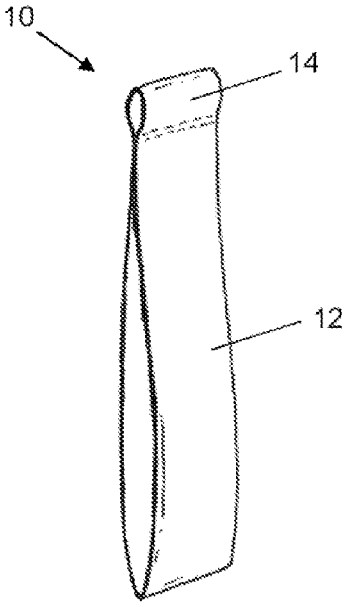
FIG. 5 is a perspective view showing the writing instrument holder and bookmark without the pull tab.
Figure 6A:
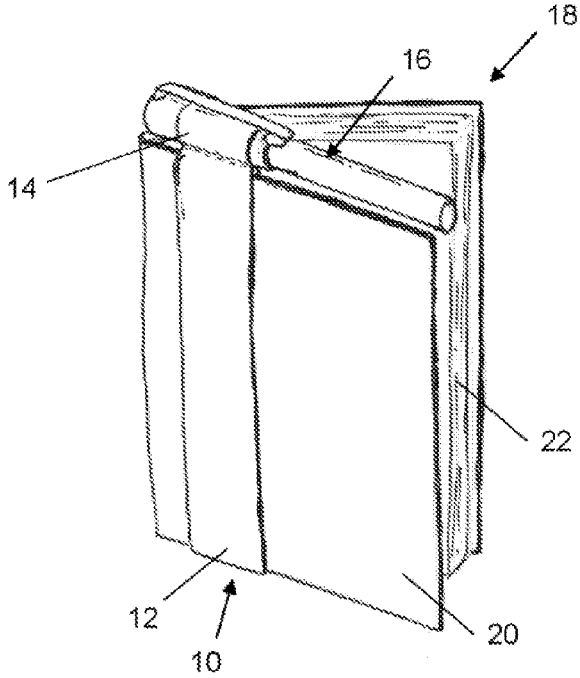
FIG. 6A is a perspective view showing the writing instrument holder and bookmark, without the pull tab, attached to the cover of a book.

FIGS. 5-6B:

The pull tab may be omitted to lower manufacturing costs, while still retaining the ability to physically tether pen 16 and secure pen holder 10 to book with main loop 12. Without the pull tab, book pages 22 can still be marked by wrapping the main loop 12 around the cover 20 and appropriate pages 22 (FIG. 6B).

Figure 7A:
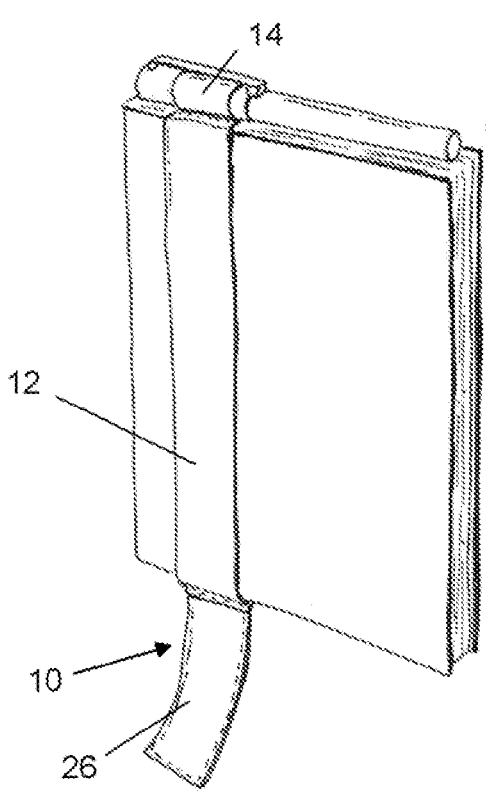
FIGS. 7A-7B are perspective and right plane views showing the use of the present invention as a book closure device, with the length of the device parallel to the spine axis.
Figure 7B:
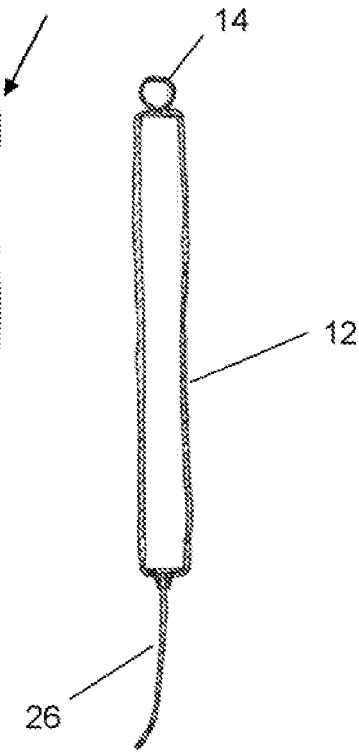

FIGS. 7-8:

Pen holder 10 can also be used to keep a book closed by stretching main loop 12 around the entire book 18. This is useful when storing loose sheets of paper or other items within the book; keeping the book closed tightly prevents these items from inadvertently falling out. FIGS. 7A and 7B show the pen holder 10 stretched over the book in a direction parallel to the spine of the book.

Figure 8:
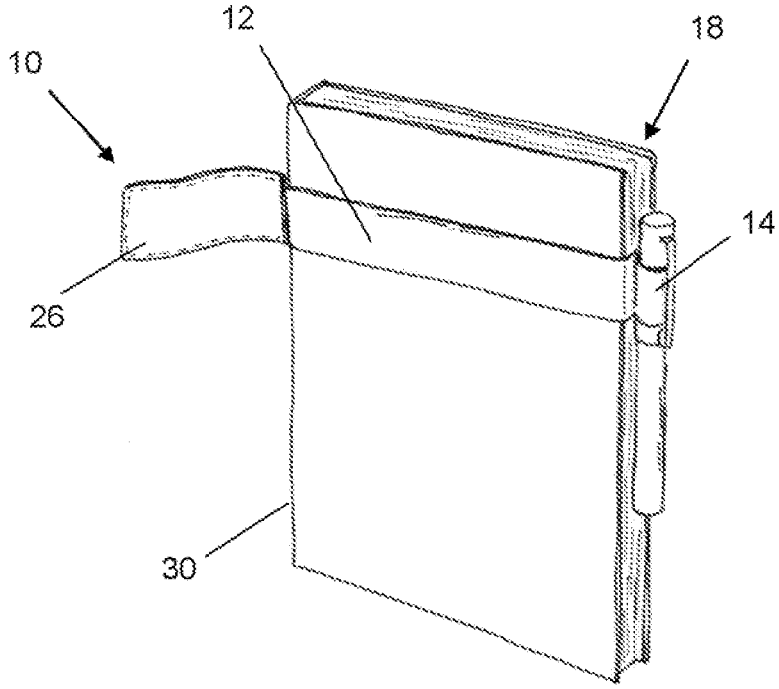
FIG. 8 is a perspective view showing the use of the present invention as a book closure device, with the length of the device perpendicular to the spine axis.

FIG. 8 shows an alternate orientation of pen holder 10 used to keep a book closed; the length of pen holder 10 is perpendicular to the book spine 30. This may be useful if book 18 is large in size and its width is more suitable than the length for securing the device. When stored in this orientation, pull tab 26 may be used to assist, both visually and physically, in retrieving book 18 when it's stored between other books on a bookshelf.

Figure 9:
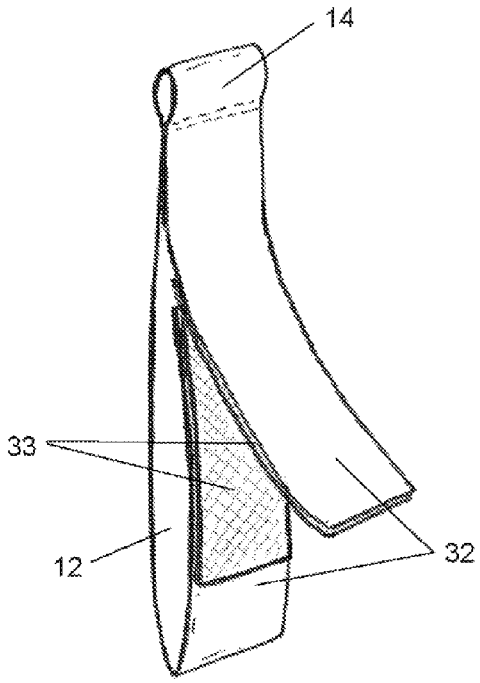
FIG. 9 is a perspective view showing the use of hook and loop fasteners to create an adjustable-length main loop.
Figure 11:
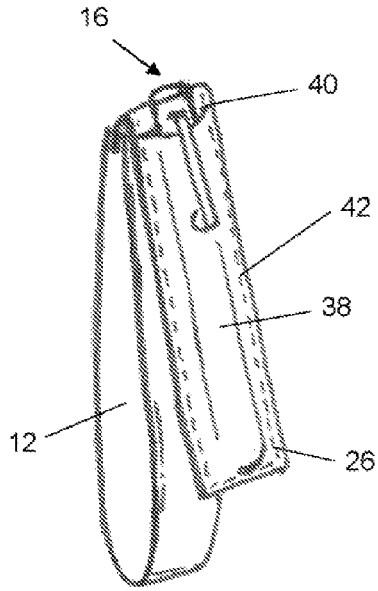
FIG. 11 is a perspective view showing the pull tab with a pocket, which contains a writing instrument.
Figure 12:
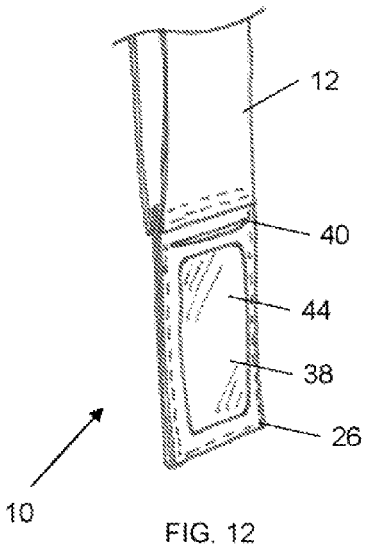
FIG. 12 is a perspective view showing the pull tab with a pocket, which includes a transparent window allowing the user to see materials/photographs stored therein.
Figure 13A:
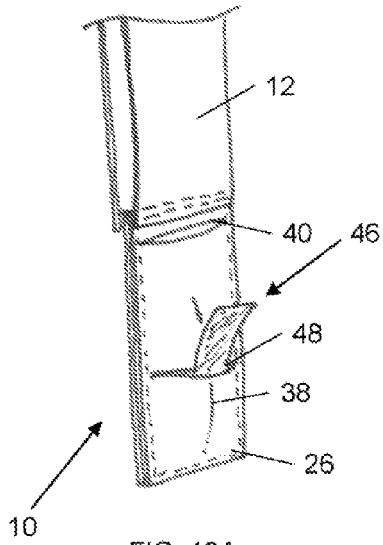
FIG. 13A is a perspective view showing the pull tab with a pocket, which is used to store and dispense self-stick note flags.
Figure 13B:
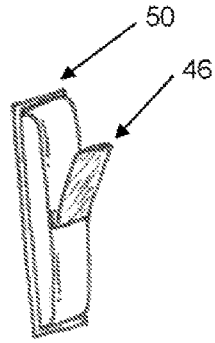
FIG. 13B is a perspective view showing an off-the-shelf self-stick note dispenser.
Figure 10A:
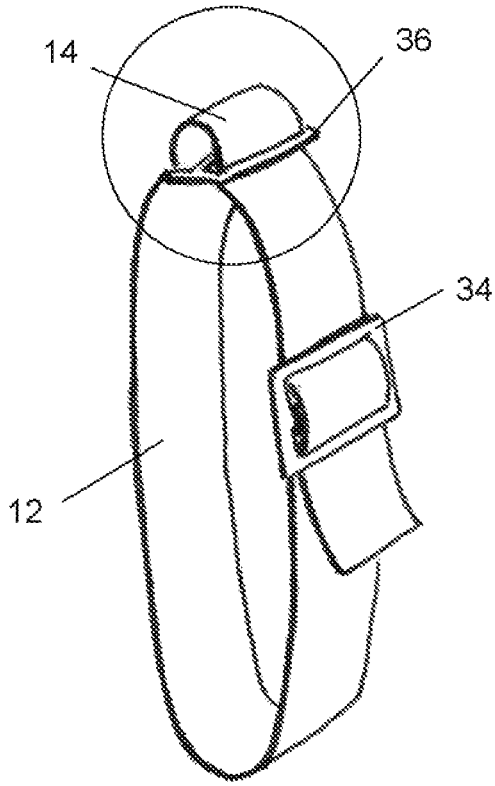
FIG. 10A-10B are perspective views showing adjustable main loop and pen loop using clasps for variable length adjustment.
Figure 10B:
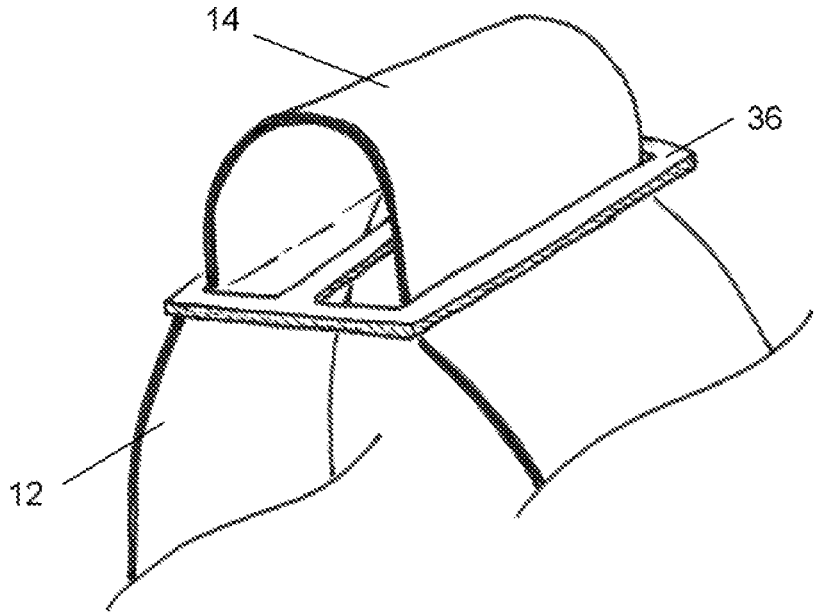

FIGS. 9-10:

In another embodiment, main loop 12 is adjustable to accommodate a larger range of book sizes. Main loop 12 has two straps 32 which attach to each other in a manner such that the overall circumference of main loop 12 is adjustable. Various attachment methods may be used, including hook and loop fasteners 33 (shown in FIG. 9), hook and grommets, and a belt-type clasp. Similarly, pen loop 14 size may be adjustable with the same attachment methods described above. In FIG. 10A, clasp 34 allows adjustment of main loop 12, and in FIG. 10B, clasp 36 allows adjustment of pen loop 14, such that many sizes of books and pens may be accommodated.

FIGS. 11-13B:

In another embodiment of the present invention, pull tab 26 has a pocket 38 to hold various objects. Pull tab 26 is comprised of 2 layers of material bonded around the perimeter with a slit 40 on the front or back surface of pull tab 26 which creates the opening to pocket 38. Bonding area 42 may include appropriate stitching, adhesive or heat weld. The following paragraphs describe different uses for the pocket.

FIG. 11:

Pull tab 26 has an elongated pocket to carry a writing instrument 16. Since writing instrument 16 is stored in pull tab 26, a pen loop in the elastic band is no longer needed.

FIG. 12:

Pull tab 26 has an integrated pocket 38 which can contain small thin objects such as a note or business card. One layer of material composing pull tab 26 may also have an integrated window 44, which allows the user to store and display a photograph or other artwork as a way to personalize the device.

FIGS. 13A-13B:

Pull tab 26 has a pocket 38 which can dispense self-stick note flag 46. Pocket 38 contains a set of self-stick notes 46, of which the adhesive may be located on alternating sides, which when guided through a narrow slit 48, the notes continuously stick out of the slit. These are also referred to as "pop-up" notes. Notes 46 can either be placed directly in the pull tab pocket 38, or a complete off-the-shelf disposable dispenser 50 with notes 46 can be inserted in the pocket.

FIGS. 14A-15A:

In another embodiment of the present invention, the pen holder 10 is formed to define three loops, a main loop 12 and two smaller pen loops 14. The pen holder can be formed using a single loop of material that is bonded in two locations to create the three loops. Main loop 12 is sized and shaped to snugly fit about either a whole book, the front or rear book cover, or the front or rear book cover and some book pages. Since the pen holder is composed of stretchable material, the device will work for a range of different sized books. In this embodiment, the device can hold two writing instruments 16, which may be convenient if using a pen and a highlighter, a pen and a pencil or two different color highlighters, as shown in FIG. 14B. The two smaller pen loops 14 can vary in size to accommodate writing instruments with different diameters, or they can be the same size. The pen loops 14 are located at opposite ends of the main loop 12 (i.e., about 180 degrees apart from one another relative to the main loop) such that the pens can be stored at the top and bottom edges of the book, which allows the book to store flat against other books on a bookshelf, table or in a backpack. The relative placement of the pen loops with respect to one another also allows the user to access the pens while the book is open; since the pen is at the top and/or bottom of the cover, the user can simply reach a short distance to remove the pen without closing or turning the book. In other words, the two pen loops 14 are about 180 degrees apart from one another relative to the main loop 12, so that two writing instruments 16 to be secured to opposite edges of a book 18 while said first main loop receives at least a cover of a book 18, as shown in FIG. 14B. In essence, the pen loops are storage facilities when the book is not in use, and they become docking stations when the book is in use. When not holding a pen, the second pen loop can also be used as a pull tab to assist in securing and removing the device 10, similar to pull tab 26 in FIG. 1.

In another embodiment, a thin elongate ribbon 52 is attached near one of the pen loops 14. This ribbon can be attached to the pen holder with the same stitch used to create the pen loop. The ribbon can be stored between pages of the book, serving as a bookmark when the book is closed. In addition, the elastic main loop 12 itself can be used as a bookmark. Attaching the ribbon near the pen loop allows the ribbon to be used as a bookmark without having to remove or reposition the main loop or remove or reposition the writing instrument. If the user does not wish to use the ribbon as a bookmark, the ribbon can remain flat against the main loop 12, where it will not be a hindrance during book usage or storage. The relative placement of the pen loop with respect to the ribbon allows the pen to remain easily accessible during open and closed book positions, while the function of the ribbon is not impeded by the presence or absence of a writing instrument. Using various graphics and designs, the ribbon can also be used as a decorative enhancement to the device. The ribbon bookmark feature can be substituted with string, wire, chain or any other thin elongate member.

Figure 4:
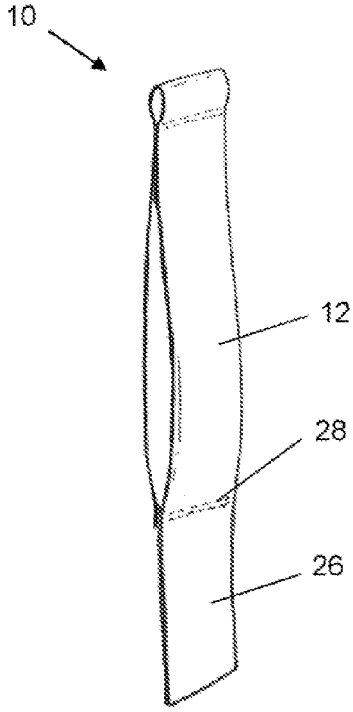
FIG. 4 is a perspective view showing the pull tab as an extension of the material composing the main loop and pen loop.
Figure 14A:
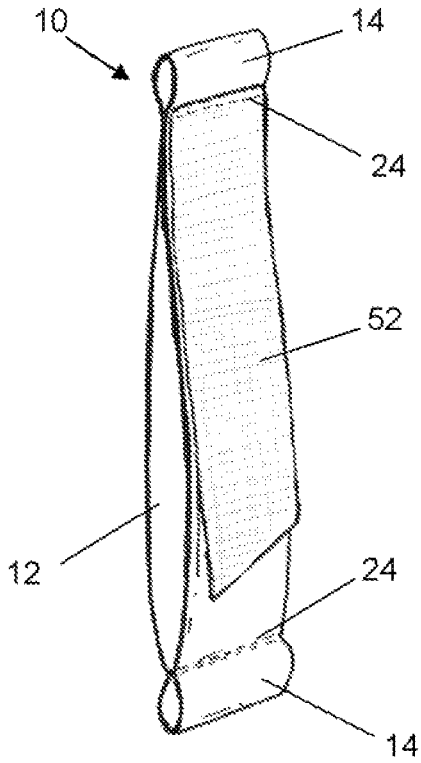
FIG. 14A is a perspective view showing the writing instrument holder and bookmark with two pen loops and an additional ribbon bookmark.
Figure 14B:
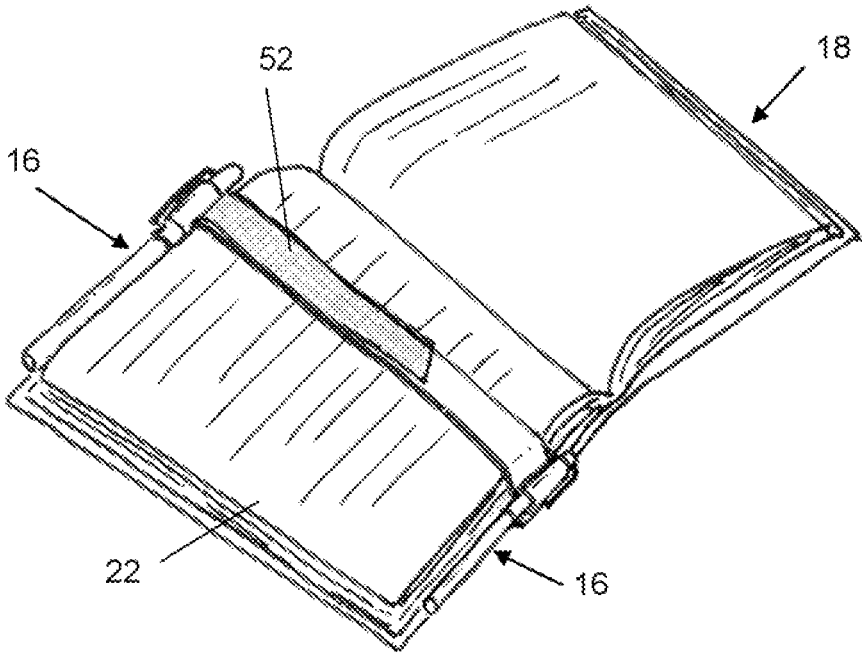
FIG. 14B is a perspective view showing the writing instrument holder and bookmark, with 2 pen loops and an additional ribbon bookmark, marking the page of a book.

It also possible that one of the small loops 14 shown in FIGS. 14A and 14B is not included. In place of the not included small loop 14 can be a pull tab, like pull tab 26 shown in FIG. 4, or nothing. For example, the elongate ribbon 52 (or other elongate member) shown in FIGS. 14A and 15B can be added to the embodiments of the pen holder 10 shown in FIGS. 4-8 discussed above, as well as other embodiments.

Figure 15:
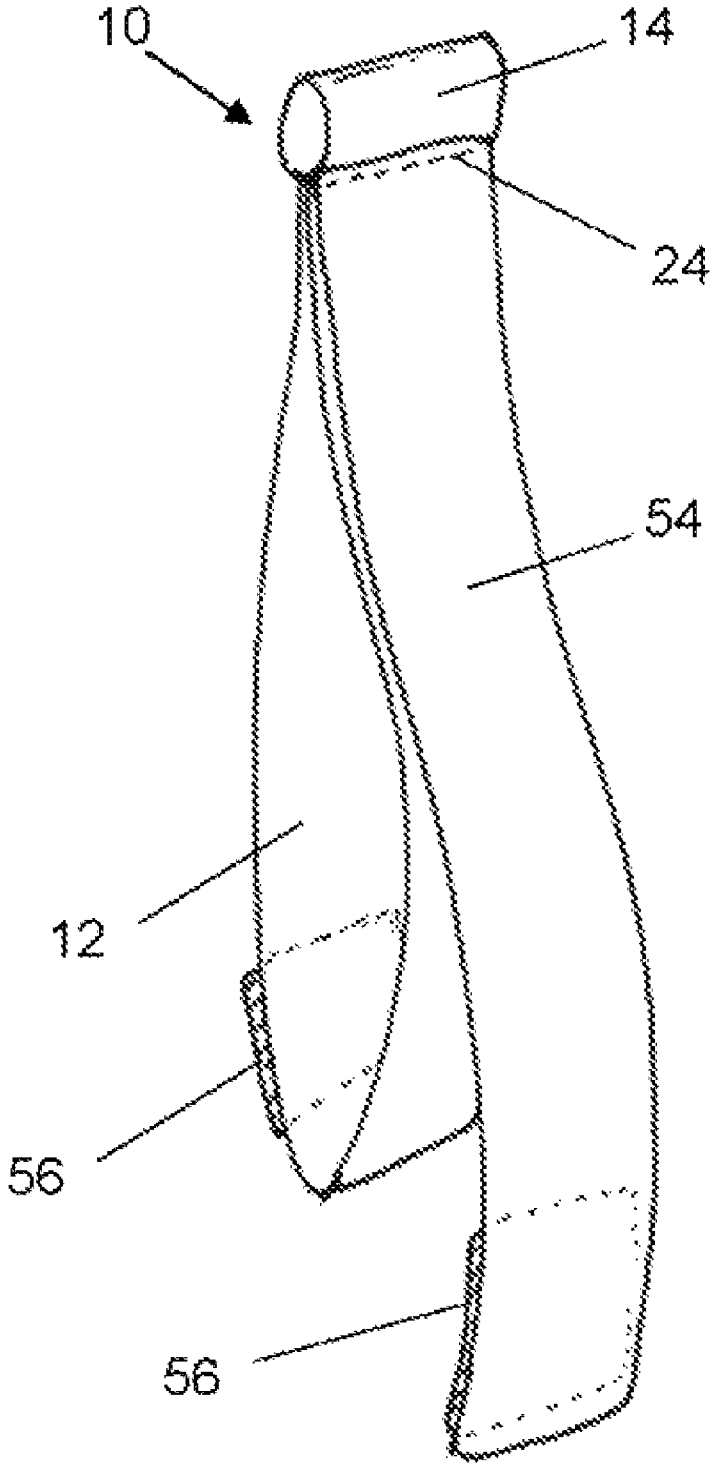
FIG. 15 is a perspective view showing the writing instrument holder and bookmark, with one pen loop and an additional elastic strap with hook and loop features, which can be used to mark the page or keep the book closed.

In another embodiment, shown in FIG. 15, the pen holder 10 is formed to define two loops, a main loop 12, a smaller pen loop 14, and a thin elongate strip 54 extending from the pen loop with hook and loop features 56 on the end of the strip and on the back of the main loop. The elongate strip 54 can serve as a bookmark which wraps around the desired page of a book and fastens to the back of the main loop, thereby securing the page for easy access once the book is reopened. Alternatively, the strip 54 can serve as a book closure device which wraps around the entire book and fastens to the back of the main loop 12. This is useful for both securing a writing instrument to the book and keeping the book closed during transportation. The relative placement of the pen loop with respect to the elongate strip allows the pen to remain easily accessible during open and closed book positions, while the function of the elongate strip is not impeded by the presence or absence of a writing instrument. Alternatively, the pen holder 10 can be used to secure a pen to clipboard, where the main loop 12 wraps around the main platform of the clipboard, the pen is held with the small loop 14, and the strip 54 can be used to secure pages on the clipboard such that the non-clipped end of the pages are held in place. The strip 54 can be a lengthened version of ribbon 52. In specific embodiments, the strip 54 is elastic. Alternative fastener parts, such as but not limited to snaps type fastener parts, can be used in place of hook and loop features 56.

From the description above, a number of advantages of the aforementioned writing instrument holder and bookmark device becomes evident:

a) The device, composed of a main loop and writing instrument loop, may be made of a single part.

b) The device is simple, cheap and easy to manufacture.

c) The user will have convenient access to a writing instrument, such as a pen or highlighter, with his journal or text book.

d) The addition of a pull tab makes the device easier to attach and remove, and it also functions as a bookmark, which can be used without disturbing the main loop or writing instrument.

e) The pull tab can incorporate a pocket in which various useful objects may be stored, such as a pen, a photograph or notes.

f) The device can be attached to and store on the cover of a book, so that the writing instrument is easily accessible while reading or writing. Alternatively, the device can be attached around an entire book, with its length parallel or perpendicular to the spine, such that the book is closed securely.

g) There is ample room for graphics on all surfaces, which can be applied inexpensively through existing embellishment processes (i.e. pad printing, foil stamping and embossing). The device can be graphically treated to enhance its aesthetic appeal.

h) The device is simple and intuitive to use.

f) The device can accommodate most standard sized writing instruments and books.

Although the description above contains many specifications, these should not be construed as limiting the scope of the invention but as merely providing illustrations of some of the present embodiments of this invention. It should be apparent to those skilled in the art that my invention may be modified in arrangement and detail without departing from the principles outlined. I claim as my invention all such modifications as come within the true spirit and scope of the following claims.

What is claimed is:

1. A combined writing instrument holder and bookmark for use with a book and a writing instrument, the combined writing instrument holder and bookmark comprising:

a first loop of material generally sized to snugly receive at least a cover of a book, said first loop defining a first central axis;

a second loop, attached to said first loop, said second loop generally sized to snugly receive a writing instrument so that a writing instrument can be secured to a book while said first loop receives at least a cover of a book, said second loop defining a second central axis that is generally parallel to said first central axis;

a third loop, also attached to said first loop, said third loop generally sized to snugly receive a further writing instrument, so that a further writing instrument can also be secured to a book while said first loop receives at least a cover of a book and said second loop receives a writing instrument, said third loop defining a third central axis that is generally parallel to said first central axis and said second central axis; and an elongate member having an attached end, a free end and a length therebetween, said attached end of said elongate member attached to said first loop at about a same location where said second loop is attached to said first loop;

wherein said length of said member is useful as a bookmark while said first loop receives at least a cover of a book; and wherein said second and third loops are about 180 degrees apart from one another relative to said first loop, so that two writing instruments can be secured to opposite edges of a book while said first loop receives at least a cover of a book.

2. The combined writing instrument holder and bookmark of claim 1, wherein said first and second loops are formed from a single loop of elastic material that is bonded together at a location along said single loop to form two loops, said two loops being said first and second loops.

3. The combined writing instrument holder and bookmark of claim 2, wherein said attached end of said elongate member is attached adjacent to said location where said single loop is bonded together to form said first and second loops.

4. The combined writing instrument holder and bookmark of claim 3, wherein stitching is used to bond together said single loop to form said first and second loops and also to attach said attached end of said elongate member.

5. The combined writing instrument holder and bookmark of claim 3, wherein said stitching that is used to bond together said single loop to form said first and second loops and said stitching that is used to attach said attached end of said elongate member is the same stitching.

6. The combined writing instrument holder and bookmark of claim 1, wherein said second loop and said third loop are about the same size.

7. The combined writing instrument holder and bookmark of claim 1, wherein said second loop and said third loop are different sizes to accommodate writing instruments of different diameters.

8. The combined writing instrument holder and bookmark of claim 1, wherein said elongate member is made of an elastic material.

9. The combined writing instrument holder and bookmark of claim 1, wherein said first, second, and third loops are formed from a single loop of material that is bonded together at two different locations along said single loop to form three loops, said three loops being said first, second and third loops.

10. The combined writing instrument holder and bookmark of claim 9, wherein said single loop of material, from which said first, second and third loops are formed, comprises a loop of elastic material.

11. The combined writing instrument holder and bookmark of claim 1, wherein while said first loop receives both a cover and a plurality of pages of a book, the first loop is also useful as a bookmark, such that the first loop can mark a page of the book, and said length of said member can mark another page of the book, while the second and third loops simultaneously receive and store two different writing instruments at opposite edges of the book.

12. A combined writing instrument holder and bookmark for use with a book and a writing instrument, the combined writing instrument holder and bookmark comprising:

a first loop of material generally sized to snugly receive at least a cover of a book, said first loop defining a first central axis;

a second loop, attached to said first loop, said second loop generally sized to snugly receive a writing instrument so that a writing instrument can be secured to a book while said first loop receives at least a cover of a book, said second loop defining a second central axis that is generally parallel to said first central axis;

a third loop, also attached to said first loop, said third loop generally sized to snugly receive a further writing instrument, so that a further writing instrument can also be secured to a book while said first loop receives at least a cover of a book and said second loop receives a writing instrument, said third loop defining a third central axis that is generally parallel to said first central axis and said second central axis; and an elongate member having an attached end, a free end and a length therebetween, said attached end of said elongate member attached to said first loop at about a same location where said second loop is attached to said first loop;

wherein said length of said member is useful as a bookmark while said first loop receives at least a cover of a book;

wherein said second and third loops are about 180 degrees apart from one another relative to said first loop, so that two writing instruments can be secured to opposite edges of a book while said first loop receives at least a cover of a book; and wherein said single loop of material, from which said first, second and third loops are formed, comprises a loop of material that includes at least one elastic portion and at least one inelastic portion.

13. A combined writing instrument holder and bookmark for use with a book and a writing instrument, the combined writing instrument holder and bookmark comprising:

a first loop of material generally sized to snugly receive at least a cover of a book, said first loop defining a first central axis;

a second loop, attached to said first loop, said second loop generally sized to snugly receive a writing instrument so that a writing instrument can be secured to a book while said first loop receives at least a cover of a book, said second loop defining a second central axis that is generally parallel to said first central axis;

an elongate member having an attached end, a free end and a length therebetween, said attached end of said elongate member attached to said first loop at about a same location where said second loop is attached to said first loop, and said length of said elongate member being longer than said first loop when said first loop is flat;

a first part of a fastener attached to an outer circumference said first loop, at least 180 degrees away from where said attached end of said elongate member is attached to said first loop; and a second part of said fastener attached to said elongate member near said free end of said elongate member;

wherein while said first loop receives at least a cover of a book, said elongate member can wrap around one or more pages of the book, and said first part of said fastener can attach to said second part of said fastener, to thereby secure the one or more pages to the cover of the book;

wherein said first and second loops are formed from a single loop of elastic material that is bonded together by stitching at a location along said single loop to form two loops, said two loops being said first and second loops; and wherein the same stitching that is used to bond together said single loop at said location to form said first and second loops is also used to attach said attached end of said elongate member.

* * * * *